US007185759B2

(12) United States Patent
Rich

(10) Patent No.: US 7,185,759 B2
(45) Date of Patent: Mar. 6, 2007

(54) ROTATING TOILET TOOL HOLDER

(75) Inventor: Ronald Rich, Burton, OH (US)

(73) Assignee: Waxman Consumer Products Group Inc., Bedford Heights, OH (US)

( * ) Notice: Subject to any disclaimer, the term of this patent is extended or adjusted under 35 U.S.C. 154(b) by 409 days.

(21) Appl. No.: 10/775,009

(22) Filed: Feb. 9, 2004

(65) Prior Publication Data

US 2005/0173277 A1 Aug. 11, 2005

(51) Int. Cl.
*B65D 83/10* (2006.01)

(52) U.S. Cl. ..... 206/349; 206/361

(58) Field of Classification Search ..... 206/349, 206/361, 362.2, 362.3; 312/206, 207, 322
See application file for complete search history.

(56) References Cited

U.S. PATENT DOCUMENTS

| | | | | | |
|---|---|---|---|---|---|
| 2,757,787 | A | | 8/1956 | Sergent | |
| 3,085,678 | A | | 4/1963 | Moore | |
| 4,008,933 | A | | 2/1977 | Wanek | |
| 4,033,650 | A | * | 7/1977 | Alissandratos | 312/206 |
| 4,317,605 | A | * | 3/1982 | Alissandratos | 312/206 |
| 4,415,211 | A | * | 11/1983 | Alissandratos | 312/206 |
| 4,458,368 | A | | 7/1984 | Webb | |
| D276,291 | S | | 11/1984 | Boroch | |
| D291,039 | S | | 7/1987 | Bokmiller | |
| D292,631 | S | | 11/1987 | Tash | |
| 4,768,237 | A | | 9/1988 | Torti | |
| D298,712 | S | | 11/1988 | Mattei | |
| 4,831,669 | A | | 5/1989 | Edwards | |
| D315,269 | S | | 3/1991 | Brazis | |
| D362,575 | S | | 9/1995 | Bird et al. | |
| 5,456,356 | A | | 10/1995 | Kurzawa | |
| D370,376 | S | | 6/1996 | Mifsud | |
| D383,935 | S | | 9/1997 | Zawalsky | |
| D400,748 | S | | 11/1998 | France | |
| 5,836,322 | A | * | 11/1998 | Borger et al. | 206/361 |
| 5,924,566 | A | * | 7/1999 | Gibbs | 206/361 |
| D413,470 | S | | 9/1999 | Burton | |
| 5,958,150 | A | | 9/1999 | Borger et al. | |
| 5,971,141 | A | | 10/1999 | Shafik | |
| 5,984,100 | A | * | 11/1999 | Ramsey et al. | 206/581 |
| D419,019 | S | | 1/2000 | Shafik | |
| D419,806 | S | | 2/2000 | Shafik | |
| 6,035,456 | A | | 3/2000 | Taylor | |
| 6,038,709 | A | | 3/2000 | Kent | |
| D423,844 | S | | 5/2000 | Bruns et al. | |
| D425,744 | S | | 5/2000 | McGuire | |

(Continued)

*Primary Examiner*—Luan K. Bui
(74) *Attorney, Agent, or Firm*—Tarolli, Sundheim, Covell & Tummino LLP

(57) ABSTRACT

A toilet tool storage device for providing accessible and transportable storage for a tool having an implement and a handle is disclosed. The device includes a first shell and a second shell. The first shell has an inner surface defining a receptacle sized to house the implement and an outer surface defining a first opening. The second shell is rotatably engaged to the first shell and has an outer surface defining a second opening. The second shell is rotatable between a first position and a second position. In the first position, the first opening and the second opening are cooperatively aligned to provide access to the receptacle so that the tool may be moved in or out of the receptacle. In the second position, the outer surface of the second shell and the first opening are cooperatively aligned prohibit access to the receptacle, thereby enclosing the implement.

25 Claims, 4 Drawing Sheets

U.S. PATENT DOCUMENTS

| | | | |
|---|---|---|---|
| 6,241,091 | B1 | 6/2001 | Moore et al. |
| D449,951 | S | 11/2001 | Schmidt et al. |
| D450,895 | S | 11/2001 | Poston |
| D450,964 | S | 11/2001 | Johnson |
| D452,401 | S | 12/2001 | Schmidt et al. |
| 6,383,457 | B1 | 5/2002 | Brown |
| D458,068 | S | 6/2002 | Hillman |
| 6,446,792 | B1 | 9/2002 | Kaniaris, Jr. |
| D463,698 | S | 10/2002 | Phillips et al. |
| D466,661 | S | 12/2002 | Schmidt et al. |
| D471,393 | S | 3/2003 | Hutchinson |
| D477,483 | S | 7/2003 | Brown et al. |
| 6,951,281 | B1 * | 10/2005 | Jeffery ..... 206/349 |

* cited by examiner

ROTATING TOILET TOOL HOLDER

FIELD OF THE INVENTION

The present invention relates to a storage device and more particularly to a toilet tool storage device having rotational features for providing access to a tool stored within the device.

BACKGROUND OF THE INVENTION

Tools designed for use with toilets, such as plungers and scrub brushes, are well-known and widely-used in bathrooms of residences, office buildings, retail establishments and restaurants. Of course, toilet brushes are used to clean the interior of a toilet bowl. It is further known and appreciated that the conventional use of a plunger is to unclog the exit piping leading from a toilet to a sewer system or other types of collection system. These known uses inherently create both sanitary and aesthetic issues for any party responsible for bathroom maintenance.

In regard to plungers, it is common to store a plunger on the floor adjacent to a toilet in a conveniently locatable site. In most application settings, it is unrealistic to sanitize the plunger after each use. As a result, moisture or residue remaining on the plunger after recent use often drips or runs to the floor. Further, the plunger itself is unsightly and may contrast with the decorum of certain bathrooms. To solve these issues, various plunger storage devices have been marketed. Some involve relatively expensive and rather complicated sanitizing systems. Other storage devices include a base system into which the plunger is either partially or completely enclosed. These devices either do not entirely hide the plunger, or are difficult for some users to open and close during plunger transfer. Further, certain devices require the user to either touch one or more parts of the holder, or the plunger cup itself, to manipulate the device during plunger transfer. It should be appreciated that a device becomes unsanitary after contact with a used plunger and any design that requires a user to touch the holder is not desired. Also, certain prior art designs are not easily transportable from one location to another when the toilet tool is in storage within the device. These designs also require a user to touch parts of the holder. As such, a tool holder is needed in the art that allows for transportation while only engaging the sanitary distal end of the tool handle.

Therefore, a toilet plunger holder that features an innocuous looking, closeable assembly that could be positioned adjacent to a toilet is needed in the art. Because the toilet plunger is unsanitary after it is used, it would be a further benefit for a toilet plunger holder to include a base upon which a recently used plunger would rest to catch any unsanitary drippings from the plunger. Further, it would be advantageous to have a plunger holder device that is operational without a user having to touch either the storage device itself or the plunger cup.

In regard to other types of toilet related tools, similar inherent problems exist with storage devices known in the art that are designed for brushes and other tools.

The present invention provides a new and improved rotating toilet tool holder for providing access directly to a tool within the holder. The present invention uses a two part shell design wherein a rotating shell is rotatably engaged to a base shell such that the user can open and close the device during tool transfer by rotating the toilet tool handle. Further, the present invention is easily transportable from one location. When in a closed position, an operator can use the handle to lift and move the tool as desired.

SUMMARY OF THE INVENTION

In an illustrated embodiment of the invention, a plunger storage device for providing accessible storage for a plunger having a cup and a handle is disclosed. It should be understood that the illustration of a plunger is for perspective and exemplary purposes only, and the invention may be practiced with the use of a toilet brush or any other toilet tool having a handle and an implement.

In one embodiment, the plunger holder includes a first shell having an inner surface defining a receptacle sized to house the cup and an outer surface defining a first opening, and a second shell rotatably engaged to the first shell. The second shell has an outer surface defining a second opening. The second shell is rotatable between a first position and a second position. In the first position, the first opening and the second opening are cooperatively aligned to provide access to the receptacle. In the second position, the outer surface of the second shell and the first opening are cooperatively aligned to prohibit access to the receptacle.

The second shell may include a cup engaging surface. The surface may be an annular shaped platform. When the cup is engaged with the cup engaging surface, rotation of the handle of a plunger in a first direction rotates the second shell toward the first position, and rotation of the handle in a second direction opposite the first direction rotates the second shell toward the second position. In the practice of the present invention, the first direction maybe clockwise or counterclockwise.

The first shell may include an outer shell mounted to a base, wherein the base comprising a plurality of bearing members contiguous with the second shell. The bearing members may be disk-shaped.

The first shell may include at least one stop tab to limit rotational movement of the second shell to between the first position and the second position.

A portion of the first opening and a portion of the second opening may form an aperture that contains the handle when the second shell is in the second position.

In another embodiment, a plunger holder includes a dome-shaped main body and a rotating member. The dome-shaped main body has a vertical center axis and includes an exterior surface, an inner surface defining a plunger storage receptacle, and a first ring extending inward within the receptacle from the inner surface along the center axis. The exterior surface defines a planar portion and a shell portion, the shell portion defining a first opening and having an annular section adjacent the planar portion and an arcuate section contiguous to the annular section. The rotating member includes a cup engaging surface, an outer surface defining a second opening, and a second ring extending inward from the rotating member inner surface along the center axis. The first ring and the second ring are rotatably engaged such that the rotating member is rotatable with respect to the main body about the center axis.

The main body may include means for reducing rotational friction between the base and the rotating member. The rotating member may be rotatably mounted within the main body.

In yet another embodiment, a plunger holder includes a first housing and a second housing. The first housing includes an inner surface and an outer surface defining a first opening. The second housing is mounted to the first member and has an inner surface and an outer surface defining a second opening. The first housing inner surface and the second housing inner surface cooperatively define a plunger receptacle area. The first housing and the second housing are concentrically mounted and the second member is rotatable with respect to the first housing.

In yet another embodiment, a plunger storage device includes a container and a sidewall. The container includes a plunger container cavity formed therein, a container top opening defined by a container top edge, and a container side wall opening defined by a container side edge. The sidewall is slidably engaged with the container and moveable from an open position to a closed position wherein the cavity is enclosed when the sidewall is in the closed position and is exposed when the side wall is in the open position. The plunger handle extends through and above the container top opening when the plunger is stored within the cavity such that the sidewall is slidable between the open and closed positions by rotation of the plunger handle.

The container may include at least one stop tab to limit movement of the sidewall to between the open position and the closed position. Alternatively, the sidewall may include at least one stop tab to limit movement of the sidewall to between the open position and the closed position. In one embodiment, the stop tabs are contiguous at the open and closed positions.

Further features and advantages of the invention will become apparent from the following detailed description made with reference to the accompanying drawings.

DETAILED DESCRIPTION OF THE INVENTION

Figure 1:
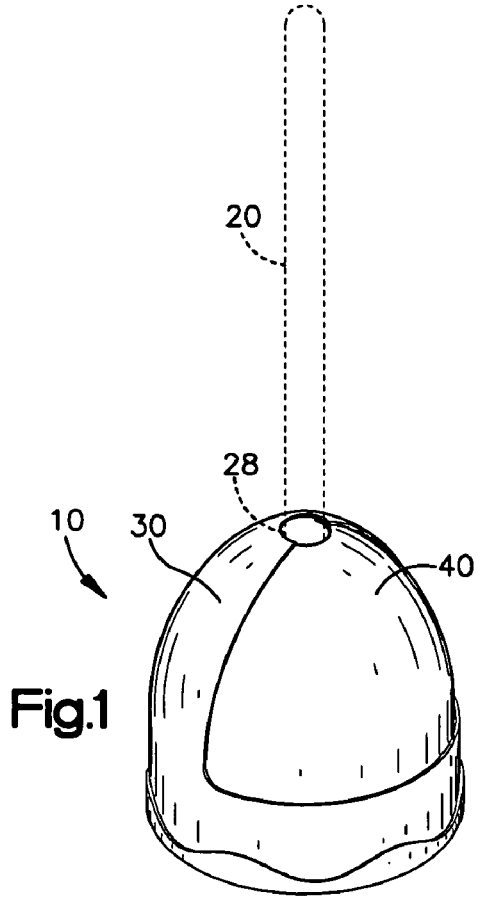
FIG. 1 is a perspective view of a rotating plunger holder constructed in accordance with one embodiment of the present invention, showing a plunger handle in dashed lines for reference only.

Referring now to the drawings, a plunger holder 10 constructed in accordance with one embodiment of the present invention is illustrated. The holder 10 proves accessible storage for a plunger 20. It should be understood that the illustration of a plunger is for exemplary purposes only, and that the present invention may be practiced with the use of a toilet brush or any type of toilet tool having a handle and an implement.

The holder 10 provides an innocuous looking, closeable assembly that can be positioned on the floor adjacent to a toilet. The holder 10 can be advantageously opened and closed by an operator by rotation of the plunger handle 22. Rotation of the plunger handle causes rotation of one moveable part of the device with respect to another part of the device which may be fixed.

Figure 5:
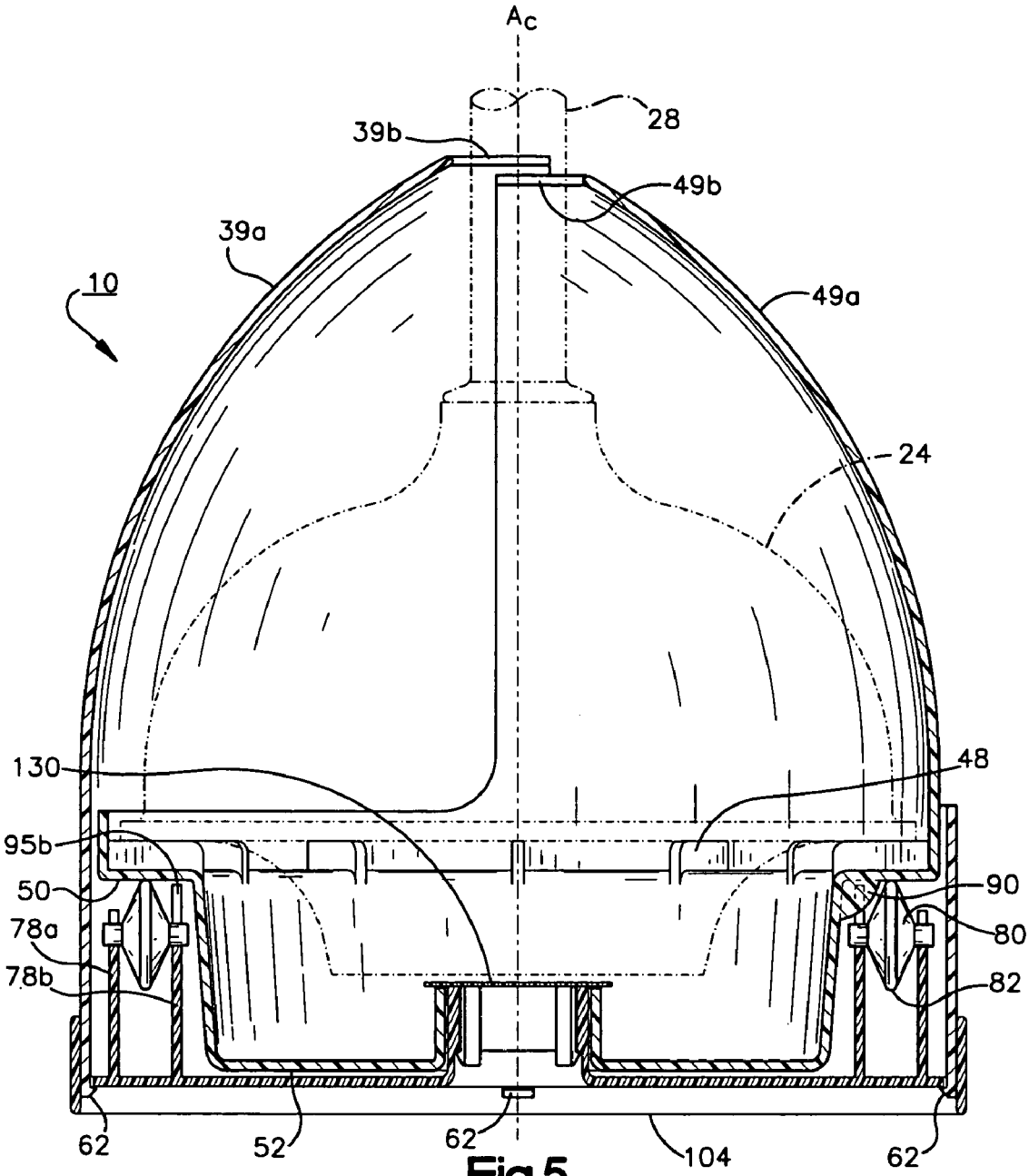
FIG. 5 is a cross-sectional view of the plunger holder of FIG. 1, showing the holder in a closed position as well as showing a plunger cup for reference only.
Figure 6:
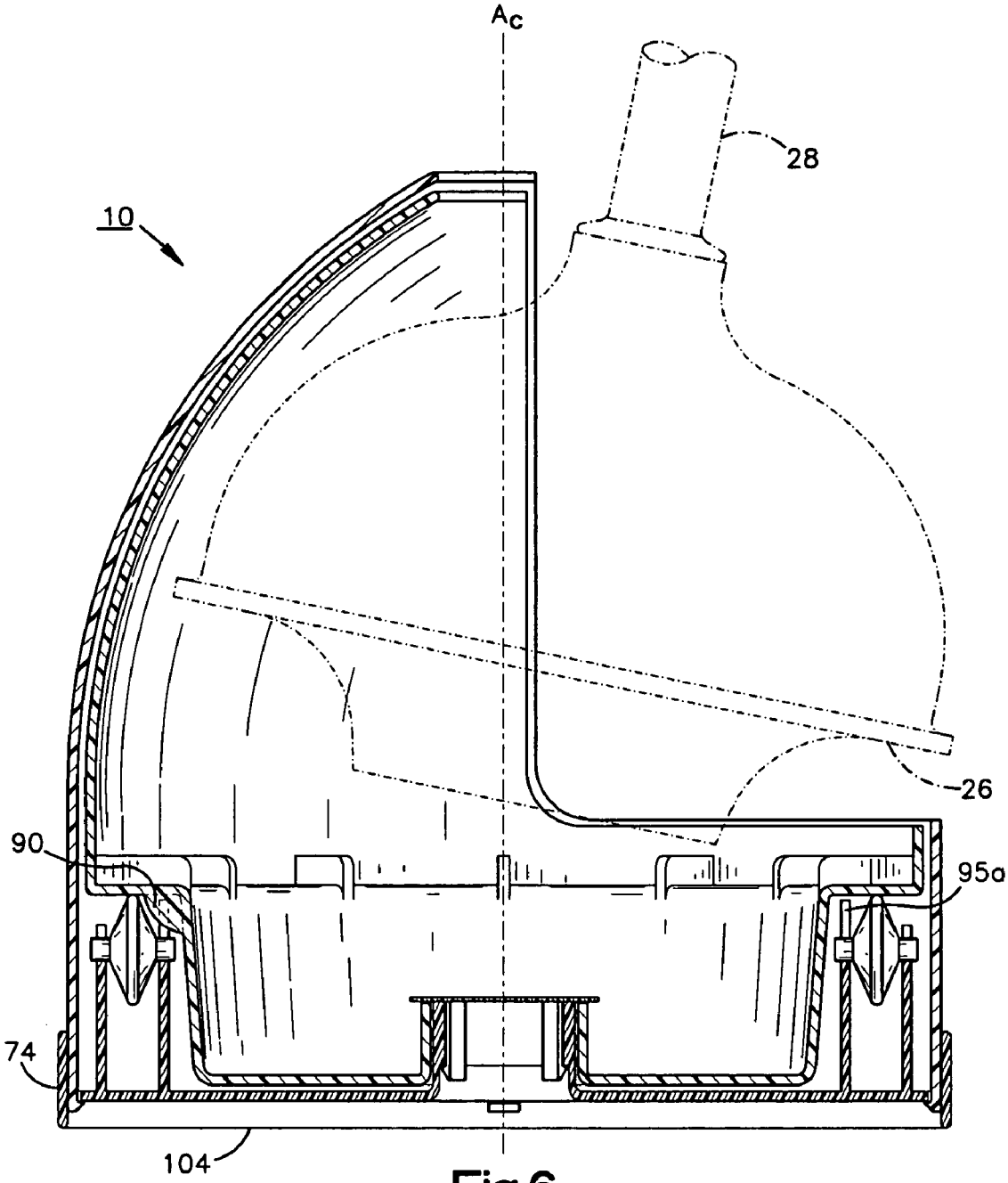
FIG. 6 is a cross-sectional view of the plunger holder of FIG. 1, showing the holder in an open position.

Referring to FIG. 1, a perspective view of a rotating plunger holder 10 constructed in accordance with one embodiment of the present invention is shown. A plunger 20 in dashed lines for reference is also shown. The plunger illustrated is conventional and includes a handle 22 and a cup 24. The cup includes a bottom surface 26 and the handle includes a portion 28 adjacent a top aperture in the holder 10, as best seen in FIGS. 5–6. It should be obvious to one skilled in art that a variety of plunger styles and designs may be used in the practice of the present invention and the plunger 20 shown is for exemplary purposes only.

The holder 10 is generally dome-shaped and includes a first shell 30 and a cooperatively formed second shell 40. As shown, the first and second shells 30, 40 are constructed of plastic by a conventional molding method. Plastics, such as polystyrene, metals, such as stainless steel, or any other suitable material may be used to construct the device. As such, it should be appreciated by others with ordinary skill in the art that various construction methods and materials may be used in the practice of the present invention. Further, in describing the present invention, the pair of terms first and second shell are not intended to be structurally limiting and are interchangeable with other pairs of terms such as, for example, first and second member, first and second housing, and rotating member and base member.

Figure 2:
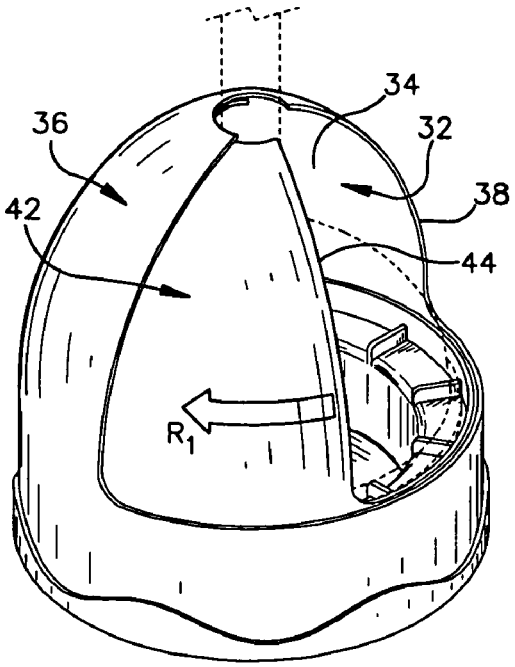
FIG. 2 is a perspective view of the plunger holder of FIG. 1, showing a rotating shell partially rotated within a base shell.
Figure 3:
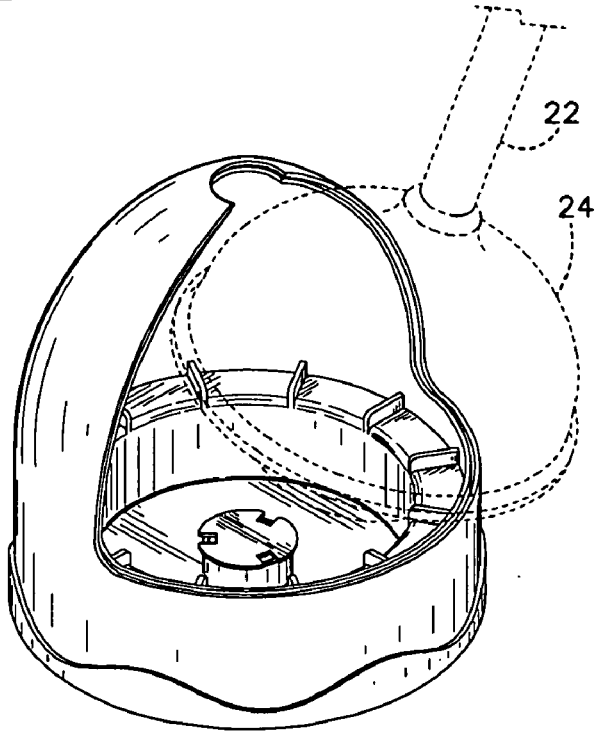
FIG. 3 is a perspective view of the plunger holder of FIG. 1, showing the rotating shell fully rotated within the base shell to expose cooperatively aligned access openings in each shell.

As seen in the perspective views illustrated in FIGS. 2–3, the rotating second shell 40 is concentrically mounted to the first shell 30 and is rotatable within the first shell 30. The first shell 30 includes an inner surface 32 that defines a receptacle 34 for housing a plunger. The receptacle, or plunger container cavity, is of an adequate shape and volume to house the plunger cup 24. One skilled in the art should understand that the cavity can also hold ball-shaped toilet scrubbers and other similar tools. As seen in FIG. 5, the cavity 34 as shown is sized larger than the cup to allow ease of plunger transfer. The first shell further includes an outer surface 36 having a first edge 39*a* that defines a first opening 38 as seen in FIG. 2. The first opening 38 is sized, at a minimum, to allow a plunger cup to be passed through the opening. As best shown in FIGS. 5–6, the first opening 38 also includes a first aperture edge 39*b* that defines a portion of a handle containing aperture.

The second shell 40 as shown is rotatably engaged to the first shell 30. The second shell 40 includes an outer surface 42 having a second edge 49*a* that defines a second opening 44. The second opening 44 is also sized, at a minimum, to allow a plunger cup to be passed through the opening, as illustrated in FIG. 3. The second shell may be a sidewall that is slideable to cover and uncover the first opening. As best shown in FIGS. 5–6, the second opening 44 also includes a second aperture edge 49*b* that defines a portion of a handle containing aperture.

Referring again to FIG. 1, the second shell 40 is illustrated fully rotated within the first shell 30 to a closed position. As illustrated, the first opening 38 and at least a portion of the outer surface 42 are cooperatively aligned to prohibit access to the receptacle 34. The outer surface 42 is essentially equal in size as the first opening 38. In this first or closed position, the plunger cup is not easily visible.

As discussed, the second shell may be rotated in a direction $R_1$ as shown in FIG. 2 to open the holder and expose the receptacle 34, and in a direction opposite $R_1$ (not shown) to close the holder and essentially enclose the receptacle. It should be understood by those with ordinary skill in the art that the direction $R_1$ is shown for exemplary purposes only, and the present invention may be practiced by the use of alternative rotational directions.

Referring now again to FIG. 3, a perspective view of the plunger of FIG. 1 is shown with the second shell 40 fully rotated within the first shell 30. As illustrated, the first opening 38 and second opening 44 are cooperatively aligned to provide access to the receptacle 34. In this second or open position, an operator may remove or install a plunger 20.

Figure 4:
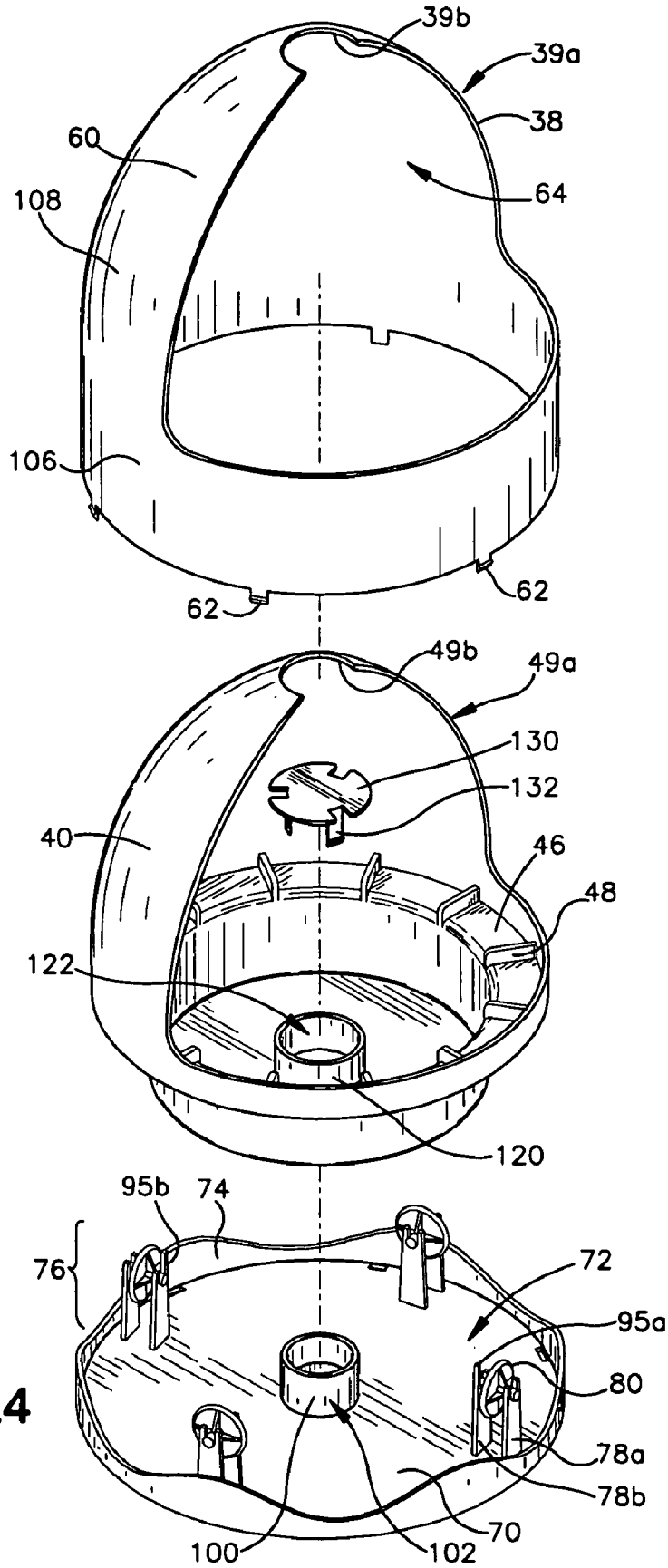
FIG. 4 is an exploded perspective view of plunger holder of FIG. 1, showing an outer shell cooperatively aligned along a common axis with the rotating shell, a ring assembly cap and a base.

An exploded perspective view of a plunger holder is illustrated in FIG. 4, showing several parts of the holder 10 cooperatively aligned along a common axis $A_c$. In the embodiment illustrated, the first shell 30 includes an outer shell 60 having an annular portion 106 contiguous with a planar portion 104, as illustrated in FIGS. 5-6. It should be obvious to one with ordinary skill in the art that the shape, appearance and design of the outer shell may vary in the practice of the present invention. As best seen in FIGS. 5–6, the outer shell includes an inner shell surface 64 and tabs 62 on its circular bottom edge. These tabs create a press-fit with a base 70 in the final assembly of the holder 10.

The base 70 is mounted to the outer shell 60 to form the first shell 30. The base includes a top surface 72, an annular wall 74, and a planar portion 104 suitable for resting on a floor or other flat surface. A flat resting surface is desirable for the common axis $A_c$ to be perpendicular to the floor for optimum operation of the holder. The planar portion 104 may include feet, non-skid pads or other traction related features to reduce slipping on wet or damp bathroom floors. The top surface 72 in combination with the annular wall 74 are adapted to retain any drippings and moisture that fall from a tool when in storage within the holder 10. The base further includes a centrally formed first ring 100 protruding from the top surface 72 to define an exterior first annular wall surface 102. The first ring 100 may be capped and hence, appear thimble-shaped.

The second shell 40 is illustrated in increased detail in FIG. 4. The second shell 40 includes a cup engaging surface 46 upon which the bottom surface 26 of the cup 24 rests. As shown, the cup engaging surface 46 is an annular shaped platform of similar size and shape as the bottom surface 26 of a conventional plunger cup 24. The cup engaging surface 46 further includes a series of radially spaced ribs 48.

The second shell further includes a centrally formed second ring 120 to define an interior second annular wall surface 122. As shown, the second ring 120 is concentric with the first ring 100 about the center axis $A_c$. The rings 100, 120 are illustrated rotatably engaged in FIGS. 5–6 such that the second shell 40 is rotatable with respect to the first shell 30 about the center axis $A_c$. The second ring 120 may also be capped and thimble-shaped.

Referring now to FIGS. 5–6, a cross-sectional view of the plunger holder and plunger are shown. In FIG. 5, the holder is illustrated in a closed position and in FIG. 6 the holder is shown in an open position. In the position shown in FIG. 5, gravity holds the plunger cup against the cup engaging surface 46. To transition the holder from the closed position to the open position, an operate must rotate the plunger handle in a clockwise direction about the center axis $A_c$. It should be understood by others with ordinary skill in the art, that the present invention can be practiced using an alternative embodiment, i.e., counterclockwise rotation to open, and clockwise to close.

The preferred operation of the device does not require any lifting of the handle to open or close the holder 10. However, pushing down slightly upon the handle is beneficial, although not required. When the handle is rotated, the ribs 48 act to add friction between the cup engaging surface 46 and the cup bottom surface 26 when the plunger handle 22 is rotated. The operator continues to rotate the handle 22 until the second shell 40 reaches the position shown in FIG. 6. To be discussed later in more detail, at least one stop tab 90 may be used on either the first shell 30 or the second shell 40 to limit rotational movement of the second shell to between the closed position and the open position.

Another benefit of the present invention is transportability from one location to another while the toilet tool is stored in the holder. In the closed position illustrated in FIG. 1, an operator can lift the distal end of the handle 22 vertically and consequently lift the holder 10. When lifted, the holder 10 remains in the closed position, such that the holder 10 is transportable from a first storage location to a second storage location by manipulation of the handle only.

An additional feature of the present invention is the use of a bearing member to reduce friction between the moving parts of the holder. As best shown in FIG. 4, the base component 70 of the first shell 30 includes a plurality of bearing members contiguous with the second shell 40. Four sets of bearing assemblies 76 are equally spaced about the exterior of the base top surface 72. The assemblies 76 consist of matching trusses, a first truss **78*a* and second truss 78*b* disposed interior from the first truss. Two of the truss assemblies include either a first or second truss stop tabs 95*a*, 95*b***.

In the embodiment disclosed, the trusses **78*a*, 78*b* are molded uniformly with the base. The distal end of each truss forms a u-shaped notch suitable for partially enclosing the axle of a bearing wheel 80. The wheel is contained within the notch by the weight of the first shell 40. More particularly, the outer wheel surface 82 is contiguous with an upper annular bottom surface 50 of the second shell. A lower annular bottom surface 52 of the first shell is contiguous to the top surface 72 of the base. As the second shell 40 is rotated, the wheels 80 turn to reduce friction between the first and second shells, 30, 40**. It should be appreciated by others with ordinary skill in the art that a variety of bearing designs and friction reducing techniques could be used in the practice of the present invention.

As previously discussed, a stop tab is used to limit rotational movement between the first and second positions. As shown in FIGS. 5–6, the second shell 40 includes a first stop tab 90 protruding from the upper annular bottom surface 50. When the second shell 40 rotates toward the open position in the direction $R_1$, the tab 90 contacts a second truss stop tab **95*b* extending from a truss assembly to prohibit additional rotation of the second shell 40. Conversely, when the second shell is rotated in a direction opposite $R_1$, a first truss stop tab 95*a* intersects with the first stop tab 90 to prohibit additional rotation of the second shell 40**. It should be appreciated by others with ordinary skill in the art that other stopping mechanism can be utilized in the practice of the present invention.

Referring again to FIG. 4, a cap 130 inserts within the second ring 120 and removably mates against the second wall annular surface 122. The cap 130 includes a plurality of insertion prongs 132 and advantageously protects the interior of the first and second rings 100, 120 by preventing foreign material from entering the rotating mechanism. It should be understood by others with ordinary skill in the art that in the practice of the present invention the cap may uniformly molded with the second shell 40.

While a single embodiment of the invention has been illustrated and described in considerable detail, the present invention is not to be considered limited to the precise construction disclosed. Various adaptations, modifications and uses of the invention may occur to those skilled in the arts to which the invention relates. It is the intention to cover all such adaptations, modifications and uses falling within the scope or spirit of the claims filed herewith.

What is claimed is:

1. A toilet tool holder for providing accessible storage for a tool having an implement and a handle, said holder comprising:

a) a first shell having an inner surface defining a receptacle sized to house the implement and an outer surface defining a first opening, the first shell defining a vertical center axis and an upper portion of the first opening defining an aperture aligned with the vertical center axis and adapted to receive the handle of the tool; and b) a second shell rotatably engaged to said first shell and rotating with respect to the first shell about the vertical center axis, said second shell having an outer surface defining a second opening, an upper portion of the second opening defining an aperture aligned with the vertical center axis and adapted to receive the handle of the tool;

c) wherein said second shell is rotatable about the vertical center axis between a first position and a second position, wherein in said first position, said first opening and said second opening are cooperatively aligned and adapted to receive the implement of the tool within said receptacle, and in said second position, said outer surface of said second shell and said first opening are cooperatively aligned to prohibit access to said receptacle.

2. The holder of claim 1 wherein said second shell comprises an implement engaging surface adapted to engage the implement of the tool when the implement of the tool is received within the receptacle.

3. The holder of claim 2 wherein said implement engaging surface is an annular shaped platform.

4. The holder of claim 1 wherein said first shell comprises an outer shell mounted to a base, wherein said base comprising a plurality of bearing members contiguous with said second shell.

5. The holder of claim 4 wherein said bearing members are disk- shaped.

6. The holder of claim 1 wherein said second shell is rotatable within said first shell.

7. The holder of claim 1 wherein said first shell comprises at least one stop tab to limit rotational movement of said second shell to between said first position and said second position.

8. The holder of claim 1 wherein the aperature defined by an upper portion of said first opening and the aperature defined by an upper portion of said second opening form an aperture that contains the handle when said second shell is in said second position.

9. A tool holder for providing accessible storage for a tool having an implement and a handle, said holder comprising:

a) a dome-shaped main body having a vertical center axis and comprising:

an exterior surface defining a planar portion and a shell portion, said shell portion defining a first opening and having an annular section adjacent said planar portion and an arcuate section contiguous to said annular section, the arcuate section defining an aperture aligned with the vertical center axis and adapted to receive the handle of the tool;

an inner surface defining a tool storage receptacle; and a first ring extending inward from said inner surface along said center axis; and b) rotating member rotating with respect to the main body about the vertical center axis, the rotating member comprising:

an implement engaging surface;

an outer surface defining a second opening, an upper portion of the second opening defining an aperture aligned with the vertical center axis and adapted to receive the handle of the tool; and a second ring extending inward from said rotating member inner surface along said center axis;

c) wherein said first ring and said second ring are rotatably engaged such that said rotating member is rotatable about the vertical center axis between a first position and a second position, wherein in said first position, said first opening and said second opening are cooperatively aligned and adapted to receive the implement of the tool within the receptacle and in said second position, the outer surface of the rotating member and said first opening are cooperatively aligned to prohibit access to said receptacle.

10. The holder of claim 9 wherein said implement engaging surface is an annular shaped platform.

11. The holder of claim 9 wherein said main body comprises a plurality of bearing members contiguous with said rotating member.

12. The holder of claim 11 wherein said bearing members are disk- shaped.

13. The holder of claim 9 wherein said main body comprises means for reducing rotational friction between said main body and said rotating member.

14. The holder of claim 9 wherein said rotating member is rotatably mounted within said main body.

15. The holder of claim 9 wherein said main body comprises at least one stop tab to limit rotational movement of said rotating member to between said first position and said second position.

16. The holder of claim 9 wherein the aperature defined by an upper portion of said first opening and the aperature defined by an upper portion of said second opening form an aperture that contains the handle when said rotating member is in said second position.

17. A toilet tool holder in combination with a tool having an implement and a handle, the toilet tool holder providing accessible storage for the tool, comprising:

a) the holder including a first shell having an inner surface defining a receptacle sized to house the implement of the tool and an outer surface defining a first opening, the first shell defining a vertical center axis and an upper portion of the first opening defining an aperture aligned with the vertical center axis and adapted to receive the handle of the tool; and b) the holder further including a second shell rotatably engaged to said first shell and rotating with respect to the first shell about the vertical center axis, the second shell having an outer surface defining a second opening, an upper portion of the second opening defining an aperture aligned with the vertical center axis and adapted to receive the handle of the tool;

c) wherein the second shell is rotatable about the vertical center axis between a first position and a second position, wherein in the first position, the first opening and the second opening are cooperatively aligned and adapted to receive the implement of the tool within the receptacle, and in the second position, the outer surface of the second shell and the first opening are cooperatively aligned to prohibit access of the implement into the receptacle; and d) further wherein when the implement is within the receptacle, the implement engages the second shell and rotation of the handle of a tool about the vertical center axis in a first direction rotates the second shell toward the first position, and rotation of the handle about the vertical center axis in a second direction opposite said first direction rotates said second shell toward the second position.

18. The holder and tool of claim 17 wherein the second shell further includes an implement engaging surface adapted to engage the implement of the tool when the implement of the tool is received within the receptacle.

19. The holder and tool of claim 18 wherein the implement engaging surface is an annular shaped platform.

20. The holder and tool of claim 17 wherein the first shell comprises an outer shell mounted to a base, wherein the base comprises a plurality of bearing members contiguous with the second shell.

21. The holder of claim 20 wherein the bearing members are disk-shaped.

22. The holder of claim 17 wherein the second shell is rotatable within the first shell.

23. The holder and tool of claim 17 wherein the first shell comprises at least one stop tab to limit rotational movement of the second shell to between the first position and the second position.

24. The holder and tool of claim 17 wherein the aperature defined by an upper portion of the first opening and the aperature defined by an upper portion of the second opening form an aperture that contains the handle when said second shell is in said second position.

25. The holder and tool of claim 17 wherein the tool is a toilet plunger and the implement is a plunger cup.

* * * * *